United States Patent [19]

Turner

[11] Patent Number: 4,811,688

[45] Date of Patent: Mar. 14, 1989

[54] THERMOGRAPHIC PRINTING MACHINE FOR A ROLLER-SUPPORTED CONTINUOUS WEB

[75] Inventor: Arthur Turner, Weybridge, United Kingdom

[73] Assignee: Adana Limited, Feltham, United Kingdom

[21] Appl. No.: 3,044

[22] Filed: Jan. 13, 1987

[30] Foreign Application Priority Data

Jan. 14, 1986 [GB] United Kingdom ..... 8600779

[51] Int. Cl.[4] ..... B05C 11/00

[52] U.S. Cl. ..... 118/674; 118/46; 118/64; 118/69; 118/643; 270/39; 270/40; 493/328; 493/329; 101/22; 101/219

[58] Field of Search ..... 118/32, 46, 67, 68, 118/69, 641, 642, 643, 674, 707, 662; 270/39, 40; 493/411, 413, 329, 328; 427/197; 101/22, 219

[56] References Cited

U.S. PATENT DOCUMENTS

| | | | |
|---|---|---|---|
| 416,380 | 12/1889 | Schleber | 118/32 X |
| 1,583,788 | 5/1926 | Gilman | 118/68 |
| 1,595,239 | 8/1926 | Minton | 118/32 |
| 2,023,019 | 12/1935 | Heppes | 118/32 |
| 2,474,775 | 6/1949 | Borchers | 493/328 |
| 2,695,244 | 11/1954 | Fountain | 118/46 |
| 3,015,577 | 1/1962 | Sacher | 118/68 |
| 3,193,403 | 7/1965 | Donelson | 118/67 |
| 3,534,952 | 10/1970 | Catallo | 493/413 |
| 3,820,700 | 6/1974 | Quirijnen | 270/39 |
| 3,937,452 | 2/1976 | Gäth | 270/39 |
| 4,051,278 | 9/1977 | Democh | 118/68 |
| 4,508,527 | 4/1985 | Uno et al. | 270/40 X |
| 4,573,670 | 3/1986 | Felix | 270/39 |
| 4,730,762 | 3/1988 | Felix | 270/39 X |

*Primary Examiner*—Shrive Beck
*Assistant Examiner*—Alain Bashore
*Attorney, Agent, or Firm*—Spencer & Frank

[57] ABSTRACT

A thermographic printing machine has a powder applicator, a heating stage, and a cooling stage wherein the heating stage has a paper transport path which is sinuous and passes on both sides of a heater, the paper passing around rollers which define the ends of the transport path. The rollers at one end do not touch the printed surface of the paper and a guide shell prevents buckling. The machine can run much faster than any previous thermographic machine because of the compactness of the heater stage. The machine may have a re-folding device for continuous fan-folded paper, wherein the paper is drawn through the machine by a drive mechanism at the exit end of the machine prior to the re-folding stage, and wherein an adjustable linkage between the drive mechanism and the re-folding device ensures re-folding of fan-fold paper of different sheet lengths.

7 Claims, 2 Drawing Sheets

THERMOGRAPHIC PRINTING MACHINE FOR A ROLLER-SUPPORTED CONTINUOUS WEB

BACKGROUND OF THE INVENTION

1. Field of the Invention

This invention relates to a thermographic printing machine and specifically, to a machine which applies a thermographic finish to matter printed by a conventional printer while the printed image is still wet.

2. Discussion of the Prior Art

Such machines have been well known for many years for printing individual sheet stock and individual cards. Attempts have been made to employ conventional machines to apply a thermographed image to continuous stationery as used for computers. This has proved to have various problems. These problems are mainly as follows:

1. It is difficult successfully to re-fold (fan-fold) the continuous paper after the thermographic treatment;

2. The shrinkage of the paper over a continuous length becomes significant and makes it difficult to recombine the thermographed paper into multi-part sets because the sprocket holes no longer line up;

3. It is impossible for a number of reasons to thermograph the continuous paper at a high enough speed. This is because the time taken to heat and then cool the thermographic 'glaze' on the printing requires a certain minimum time, and this implies that , the faster the paper moves, the longer the machine. Machines up to 6 m. long have been tried.

The invention aims to overcome or ameliorate these problems.

SUMMARY OF THE INVENTION

According to a first aspect, the invention provides a thermographic printing machine comprising a powder applicator, a heating stage, and a cooling stage wherein the heating stage has a paper transport path which is sinuous and passes on both sides of a heater, the paper passing around rollers which define the ends of the transport path.

Such a machine has the advantages that the use of a sinuous path rather than the conventional straight one allows the length of the machine to be reduced and its speed to be increased. In addition, more efficient use of the heaters makes the machine more economical to run. The machine may be used for sheet fed or continuous stationery. The rollers at one end of the sinuous path may be arranged not to contact one side of the paper, and be provided with a guide shell which prevents buckling.

According to a second aspect, the invention provides a thermographic printing machine comprising a powder applicator, a heating stage, a cooling stage and a refolding device for continuous fan-folded paper, wherein the paper is drawn through the machine by a drive mechanism at the exit end of the machine prior to the re-folding stage, and wherein an adjustable linkage between the drive mechanism and the re-folding device ensures re-folding of fan-fold paper of different sheet lengths.

This new form of paper transport avoids previous problems arising from the system formerly used to carry paper through conventional machines. In those, a continuous conveyor belt ran through both heating and cooling stages, and it was difficult to ensure that any re-folding device used was synchronised with the perforations of the paper. The new machine overcomes this.

DESCRIPTION OF THE PREFERRED EMBODIMENT

Figure 1:
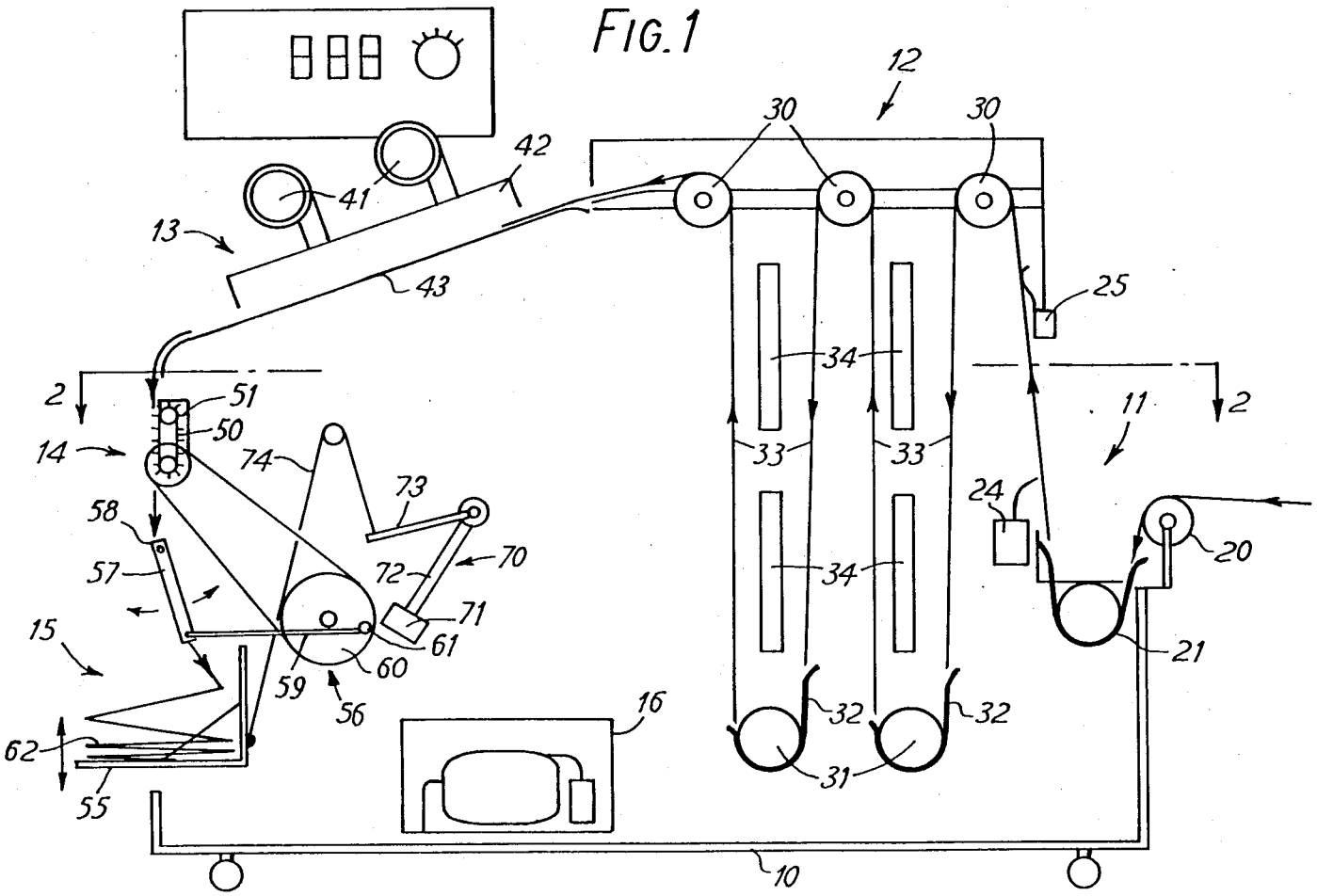
FIG.1 shows a schematic view in elevation of a thermographic printing machine in accordance with the invention.
Figure 2:
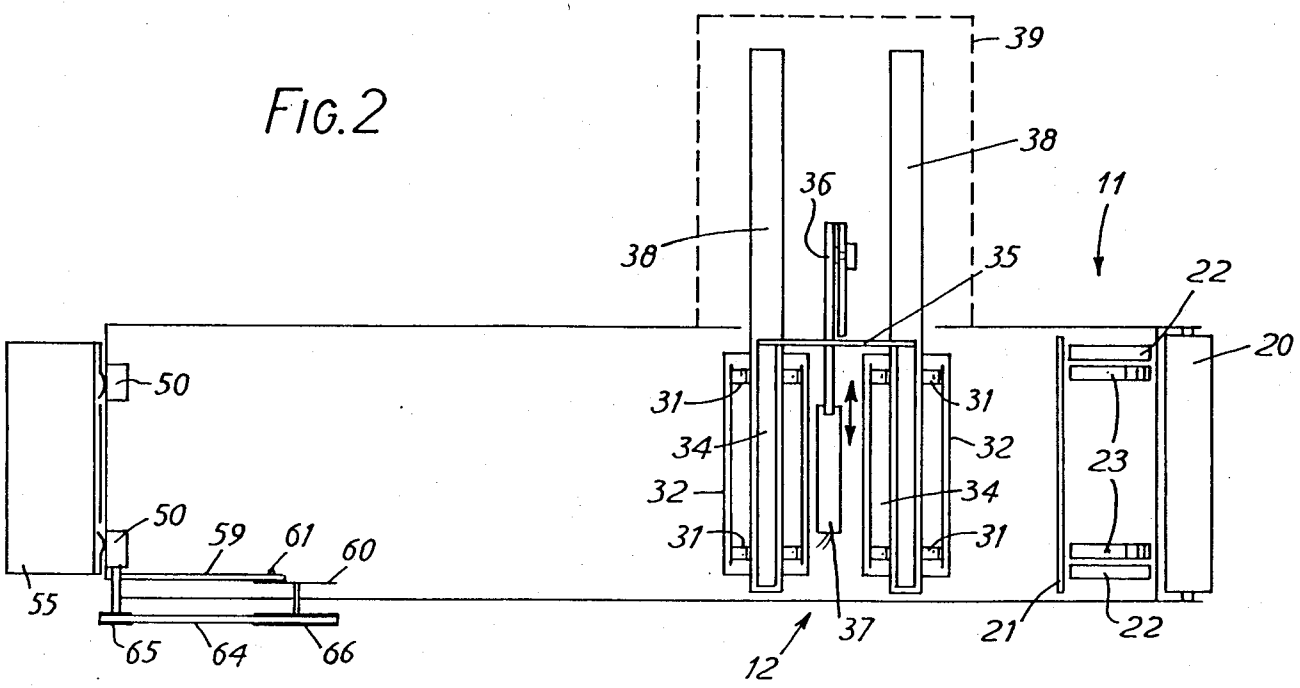
FIG.2 shows a schematic sectional view of the machine taken along line 2—2 in FIG. 1.

A wheeled frame 10 supports the machine, which has as main parts a powder applicator 11, a heating stage 12, a cooling stage 13, a drive mechanism 14 and a refolding stage 15. The machine is driven by a pneumatic unit 16 with a reservoir. Overall, the frame is about 2 m long, 1.2 m high and the main part of the machine, excluding the side extension visible in FIG. 2, is about 0.5 m wide. The machine is designed for processing a continuous web of paper which is cross perforated at regular intervals to define sheet lengths, and has a continuous row of punched holes along each side. This is normally known as 'continuous stationery' and is for computer use. Its path through the machine is shown by a continuous line with arrows.

The powder applicator 11 comprises a fixed incoming roller 20 which leads the paper web, newly printed on the upper side only, into a trough 21. This forms a 'bath' for thermographic powder through which the paper passes. The trough has fixed end walls 22 and edge rollers 23 which force the paper to follow a semicylindrical path and define its side-to-side position.

The rollers 23 do not touch the printed area of the paper which thus comes freely into contact with the powder in the trough. For different paper widths, the whole trough can be changed, which is easier and cheaper than having adjustable end walls.

In passing through the trough 21, the still wet ink on the web picks up a layer of powder. As the web emerges, a vibrator 24 against the back of the web causes excess powder to be shaken off. Above this, at one side of the web so as not to touch the printed area, is a sensor 25, for example a microswitch or photoelectric unit, which senses whether the paper web is present and under tension.

The web then enters the heating stage 12. This has the form of a festoon with rollers 30 at the top and 31 at the bottom. Rollers 30 are solid and extend across the machine; they are supported in self-aligning roller bearings in order to reduce friction to a minimum.

Rollers 31 are only narrow and positioned at the edges, again so as not to contact the printed area. They are held within semi-cylindrical troughs 32, which serve the function, since the rollers are only at the edges, of preventing the paper web buckling in the middle area.

Between the successive vertical runs 33 of the web are heater elements 34 which heat the printed side only of the web. The heat of the heaters 34 is effectively used twice, by contrast with known machines which have heaters positioned only above the paper which passes below on a conveyor. It will be clear that the four runs of paper are approximately equivalent to a horizontal machine having a length four times the distance between the upper and lower rollers.

As seen particularly in FIG. 2, the heaters elements 34 are together mounted on a frame 35 at one side. A mechanical linkage 36 connects the frame to a pneumatic cylinder 37, which can thus move the entire frame 35 with heaters 34 into and out of position between the runs of the paper web. For this purpose the heater elements are supported on rails 38. The linkage 36 is arranged to move the heaters a distance twice the stroke of the cylinder 37. In the displaced position to one side of the machine, the heaters are surrounded by a protective frame 39.

The purpose of this arrangement is to ensure that the paper can be set in motion before the heaters are introduced. Further, they can be very rapidly withdrawn if the sensor 25 detects a lack of, or loss of tension in, the paper web. This is important if the web tears, or bursts along the perforations, since there is then a danger that a loose end could touch the heater and start a fire. When withdrawn, the heaters are also automatically switched off.

In this embodiment, four heater elements 34 are used, each being six sections of 500 W each, a total of 12 KW. As is conventional, within the heating stage the thermographic powder is melted and forms a continuous glaze over the printing to which it has adhered.

Following the last roller 30, the web passes to the cooling stage 13. This has two blowers 41 within a housing 42, directed towards a stationary support plate 43. This is sufficient to remove the heat held by the paper web, and the molten powder solidifies to form a hard glaze on the printing, simulating an embossed image.

Beyond the cooling stage is the drive mechanism 14. This is a 'tractor' drive of a kind known in computer printers, which may employ driven wheels with projecting pins, or as in this case driven belts 50 with projecting pins 51 positioned on each side of the web and engaging the edge perforations thereof. The spacing of the belts can be altered to suit the width of the paper. The belts 50 are themselves driven by sprocket wheels under control of a pneumatic motor operated from the unit 16.

It will be seen that the paper web is thus pulled through the machine from the exit end thereof. This ensures that the web is kept taut, particularly through the heating stage.

Finally, the web reaches the re-folding stage 15 which has a paper tray 55 and a 'flip-flop' mechanism 56. The latter comprises a paper guide 57 pivotted to swing about point 58. At its lower end, the guide is connected by a connecting rod 59 to a drive wheel 60 where it is pivotted eccentrically at 61. Rotation of wheel 60 thus causes the guide 57 to pivot to-and-fro. This action, provided it is accurately synchronised with the perforations of the paper web, causes the web to fall in a perfect fan-fold pile 62 on the tray 55.

The synchronisation is achieved by a linkage between the drive mechanism 14 and the 'flip-flop' mechanism 56. This comprises a toothed belt 64 between a pulley 65 on the tractor drive and a pulley 66 attached to the drive wheel 60. Thus, the mechanism 56 is always matched in speed to the transport of the web. The adjustment of the frequency to match the distance between the perforations is accomplished by replacement of the pulley 66 according to the sheet length, i.e. by a change in the gear ratio.

It is also important that the vertical distance between the bottom of the guide 57 and the top of the paper pile 62 on the tray 55 should remain at least approximately constant. For this purpose, the tray is made vertically movable under control of a counterbalance mechanism 70, this comprises a weight 71 on a pivotted arm 72. This is connected to a further arm 73, and in turn to a cord or wire 74 attached to the tray 55. As the weight of paper on the tray increases, the weight 71 lifts and the tray can drop.

In operation, the thermographic printing machine described meets all the problems outlined, and also provides other advantages. The fastest that a conventional machine can operate, using continuous stationery, is about 1200 m/min. The new machine will operate successfully at 3000 m/min, and possibly even faster. Its electricity consumption is 12 KW, where a conventional machine, if it could operate at the same speed, would require about 15–16 KW.

The reasons for these advantages are as follows. First the heat is economically used in the festoon, with less heat being wasted than in a conventional elongated drier. Second, the web, in the heating stage moves in air, rather than resting on a conveyor belt. Thus heat is not wasted heating the conveyor belt, which must then be cooled in the cooling section. The cooling section has an initially cold base plate over which the paper web passes as it is cooled. For this reason, fewer cooling fans are required, reducing both capital, running expenses, and size.

Because of the reduction in length of both the heating and cooling stages, the machine can be mounted on castors and easily moved out of the way when not required, which is not possible with conventional machines elongated to cope with continuous stationery.

The re-folding section, because it ensures trouble free re-folding also contributes to enabling the faster operation of the whole machine. it is able to do this because of the close association between the drive and the flip-flop mechanism. Previously, the flip-flop used to get out of synchronism with the flow of paper and the machine would have to be stopped. The system disclosed would be useful even if the festoon-type drier were not used.

Further, the dynamics of the system having a paper drive which pulls from the output end should be noted. The pull required depends upon the friction of the whole machine, including all the rollers of the system. There is therefore a balance to be achieved between the pull exerted and the number of rollers and changes of direction of the web. The limit on the pull usable is of course the bursting strength of the web perforations.

Since the pull acts on the length of web as it comes through the machine, this has the beneficial effect of preventing shrinkage of the web under the effect of the successive heating and cooling. Moreover, the sinuous path of the web in the heating stage also prevents 'solidification' of the fibres of the web which both avoids shrinkage, and maintains the flexibility necessary to allow proper re-folding of the web at the end.

It may be noted finally that it is probably not feasible to use a horizontally sinuous path for the web in the heating stage, because of the sagging which would occur. Further at all times the machine should be run carefully up to speed so as to avoid excessive stress on the web and the resultant bursting.

In a modification, the sensor 25 may be a simple tachgenerator which is driven by frictional contact with the paper web. If this is absent, or stopped, or moving too slowly, the heaters are withdrawn to avoid the danger of fire.

I claim:

1. A thermographic printing machine for passing therethrough continuous paper having an indefinite length, a width, a printed face and a non-printed reverse face, comprising:

a powder applicator arranged for coating the printed face of the paper;

a plurality of spaced heaters each having opposite heater faces;

guide means for supporting the continuous paper in a sinuous path having a series of first locations of reversal and a series of second locations of reversal; said guide means including a first roller at each said first location of reversal; each first roller having a surface arranged for engaging the continuous paper along its entire width on the reverse face thereof;

a second roller at each side second location of reversal; each said second roller having a surface arranged for engaging the continuous paper solely along opposite marginal zones on the printed face thereof; said continuous paper being trained alternatingly about the first and second rollers and positioned by said first and second rollers such as to pass along each side of said heaters while presenting the printed side theretoward;

a cooling means for exposing said continuous paper to a cooling effect subsequent to an exposure of said continuous paper to heating by said heaters and means for pulling said continuous paper consecutively through said powder applicator, said guide means and said cooling means.

2. A thermographic printing machine as defined in claim 1, wherein said machine has two longitudinal sides; further comprising a frame carrying said heaters; said frame being movable to a first position between two adjacent runs of said sinuous path and a second position outside one of said longitudinal sides.

3. A thermographic printing machine as defined in claim 2, wherein said frame is movable in a direction parallel to the paper width.

4. A thermographic printing machine as defined in claim 2, further comprising a detector for sensing the speed of the paper and for triggering movement of said frame to said second position when the paper is moving at a speed less than a predetermined limit.

5. A thermographic printing machine as defined in claim 4, wherein said detector is a tachogenerator.

6. A thermographic printing machine as defined in claim 1, wherein said means for pulling said continuous paper comprises a drive mechanism at an exit end of said machine; further comprising a refolding means for refolding the paper; said refolding means including a pulley operatively connected with said drive mechanism to be rotated by said drive mechanism;

a drive wheel rotated by said pulley;

a paper guiding member being supported for a pivotal motion; and a connecting rod jointed to said paper guiding member and eccentrically articulated to said drive wheel for imparting a back-and-forth pivotal motion of said paper guiding member by said drive mechanism for effecting fanfolding of the paper;

said pulley being replaceable and having a determined diameter for establishing a determined driving ratio between said driving mechanism and said pulley, whereby the rotational frequency of said drive wheel can be arbitrarily changed for adapting the refolding means to different folded lengths of the paper.

7. A thermographic printing machine for passing therethrough continuous paper having an indefinite length, a width, a printed face and a non-printed reverse face, comprising:

a powder applicator arranged for coating the printed face of the paper;

a plurality of spaced heaters each having opposite heater faces;

guide means for supporting the continuous paper in a sinuous path having a series of first locations of reversal and a series of second locations of reversal; said guide means including a first roller at each said first location of reversal; each first roller having a surface arranged for engaging the continuous paper along its entire width on the reverse face thereof;

a second roller at each said second location of reversal; each said second roller having a surface arranged for engaging the continuous paper solely along opposite marginal zones on the printed face thereof; said continuous paper being trained alternatingly about the first and second rollers and positioned by said first and second rollers such as to pass along each side of said heaters while presenting the printed side theretoward;

a cooling means for exposing said continuous paper to a cooling effect subsequent to an exposure of said continuous paper to heating by said heaters;

means for pulling said continuous paper consecutively through said powder applicator, said guide means and said cooling means; and a semi-cylindrical trough positioned along each said second roller for preventing the paper from buckling.

* * * * *